US006467448B2

(12) United States Patent
Wisnia et al.

(10) Patent No.: US 6,467,448 B2
(45) Date of Patent: Oct. 22, 2002

(54) REMOTE ENGINE STARTER SYSTEM

(75) Inventors: Jack Wisnia, Dollard-des-Ormeaux; Jean-Pierre Lavoie, Town of Mont Royal, both of (CA)

(73) Assignee: 3061868 Canada Inc., Dollard des Ormeaux (CA)

( * ) Notice: Subject to any disclaimer, the term of this patent is extended or adjusted under 35 U.S.C. 154(b) by 0 days.

(21) Appl. No.: 09/755,052

(22) Filed: Jan. 8, 2001

(65) Prior Publication Data

US 2002/0088419 A1 Jul. 11, 2002

(51) Int. Cl.[7] ..... F02N 17/00
(52) U.S. Cl. ..... 123/179.2; 307/10.6; 324/402
(58) Field of Search ..... 123/179.2; 324/169, 324/170, 175, 378, 402; 307/10.6

(56) References Cited

U.S. PATENT DOCUMENTS 4,080,537 A 3/1978 Bucher
4,674,454 A 6/1987 Phairr
5,024,186 A 6/1991 Long et al.
5,043,659 A * 8/1991 Lowmiller et al. ..... 324/402
5,129,376 A 7/1992 Parmley
5,612,578 A 3/1997 Drew
5,656,868 A 8/1997 Gottlieb et al.
5,673,017 A 9/1997 Dery et al.
5,689,142 A 11/1997 Liu
5,942,988 A 8/1999 Snyder et al.

* cited by examiner

*Primary Examiner*—Andrew M. Dolinar
(74) *Attorney, Agent, or Firm*—Ogilvy Renault; James Anglehart

(57) ABSTRACT

A tachometer apparatus of a remote vehicle starting system for providing tachometric information. The apparatus includes an antenna disposed proximate to the engine compartment of the vehicle and adapted to pick up an RF signal generated by the firing of the spark plugs in the engine compartment. The apparatus also includes an RF detector having the antenna coupled to the input thereof and providing at its output a tachometer signal for coupling to a controller and providing a signal indicative of the running status of the vehicle engine and of the tach speed of the engine.

20 Claims, 2 Drawing Sheets

REMOTE ENGINE STARTER SYSTEM

TECHNICAL FIELD

The present invention relates to a remote engine starter system and pertains, more particularly, to an improved tachometer apparatus employed in such an engine starter system.

BACKGROUND OF THE INVENTION

A remote engine starter system typically includes, inter alia, a tachometer to sense the proper operation of the engine. The tachometer may be coupled to control circuitry for controlling operation of the remote engine starter system.

One example of the use of a tachometer in a remote automobile starter is found in U.S. Pat. No. 5,024,186 to Long et al. It is noted in this patent that they provide an inductive pick-up arrangement that clamps around any one of the spark plug wires coming from the distributor. This inductive pick-up has a coil of wire with one side going to ground and the other side going to the remote automobile starter unit at the tach input thereof. This inductive pick-up outputs a pulse every time a sparkplug fires.

Another tachometer arrangement employs a sense wire to the ignition coil. This requires a specific tachometer wire and an extra sense line.

In older remote controlled engine starter systems, vacuum switches operatively connected to the engine's intake manifold were used to detect that the engine was running. Magnetic sensors mounted in the engine's flywheel have also been used to determine engine speed.

In the above examples it is noted that separate hard wiring is required to certain engine components such as an ignition coil or a spark plug. This extra wiring can be problematic and is time consuming to install in vehicles.

Accordingly, it is a purpose of the present invention to provide an improved tachometer apparatus for use with a remote engine starter system that does not require extra wiring and that is characterized by a simple installation on a wide variety of vehicles.

SUMMARY OF THE INVENTION

According to the invention, there is provided a tachometer apparatus for providing tachometric information to a controller of a remote vehicle starting system. The controller is remotely activated to initiate a starting of the vehicle engine. The tachometer apparatus in accordance with the invention comprises an antenna disposed proximate to the engine compartment of the vehicle and adapted to pick-up an RF signal generated by the firing of the spark plugs in the engine compartment. The apparatus further comprises an RF detector having the antenna coupled to the input thereof and providing at its output a tachometer signal for coupling to the controller and providing a signal indicative of the running status of the vehicle engine.

In a preferred embodiment of the present invention, the RF detector uses as an antenna the existing hood pin switch wire, which is usually a safety feature of a remote engine starter system. The hood pin switch sensor located in the engine compartment is used to monitor the opening of the hood to disable the remote engine starter if the hood is opened. The proximity of this to the engine cylinders and ignition system make it possible to us the hood sensor conductor line to pick up the RF signal generated by the firing of the spark plugs in the engine compartment. In other embodiments of the invention the antenna may be power lines that run in the engine compartment or, alternatively, one may dispose a separate antenna element in the engine compartment.

There is also provided, in accordance with the present invention, a method of generating tachometric information to a controller that is part of a remote vehicle starting system that may be remotely activated to initiate a starting of the vehicle engine. In accordance with this method there is the step of detecting an RF signal generated by the firing of the spark plugs in the engine compartment, followed by the step of generating a tachometer signal derived from the detected RF signal, coupled to the controller, and indicative of the running status of the vehicle engine.

BRIEF DESCRIPTION OF THE DRAWINGS

The invention will be better understood by way of the following detailed description of a preferred embodiment with reference to the appended drawings, in which.

DETAILED DESCRIPTION OF THE PREFERRED EMBODIMENT

Figure 1:
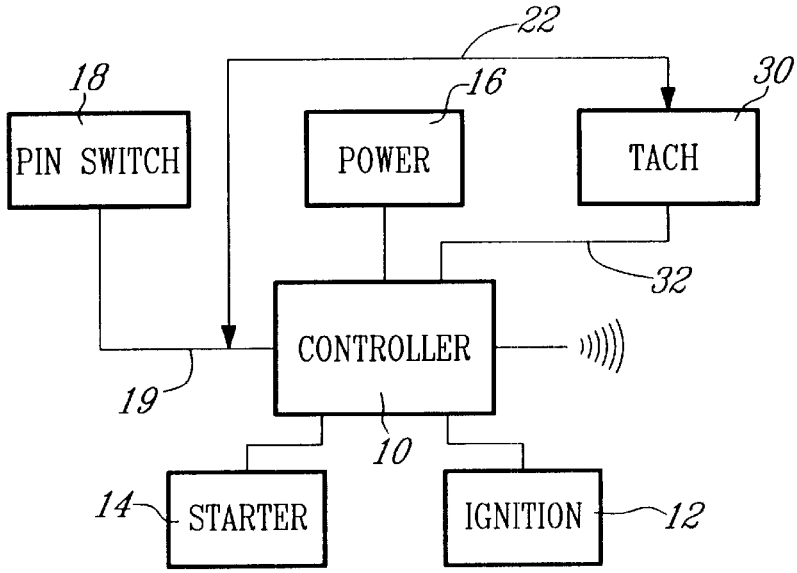
FIG. 1 is a block diagram of the remote engine starter system of the present invention.

Reference is now made to the block diagram of FIG. 1 which generally illustrates a remote engine starter system, the heart of which is the controller 10. Because the concepts of the present invention relate primarily to the tachometer apparatus, the details of the controller 10 are not described herein. Reference may be made, for example, to U.S. Pat. No. 5,942,988 that shows a controller or another example is U.S. Pat. No. 5,024,186 which shows control circuits. The purpose of the present invention is to provide a detection of engine tachometric information through an RF pulse detector circuit all as part of a remote engine starter system, such as illustrated in FIG. 1.

Figure 3:
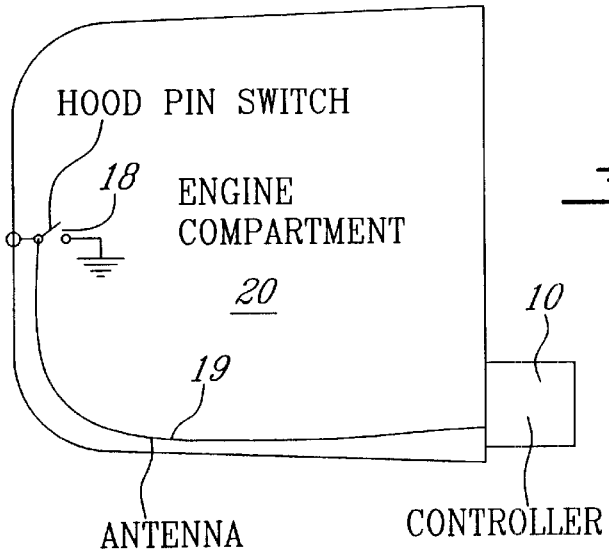
FIG. 3 is an illustration of the antenna structure of the present invention, particularly relating to an embodiment employing the wiring to the hood pin switch.

Typical of connections to the remote engine starter system include ignition 12, starter motor 14, a power source 16, and connection to a pin switch 18. It is noted that there is a line 19 that is generally a one-conductor line that couples from the controller to the hood pin switch 18. In this regard also refer to FIG. 3 which shows generally the engine compartment 20 with the line 19 extending therethrough from the controller 10 to the hood pin switch 18. It is this line 19 that functions as an antenna in accordance with the present invention, for detecting RF signals.

In FIG. 1 the line 22 simply represents a connection from the antenna line 19 to the input of the tachometer circuit 30. The output of the tachometer circuit 30, it is noted in FIG. 1, connects to the controller 10. This output line 32 provides a tachometric signal to the controller 10 to indicate that the engine has started properly and is running on its own.

An engine distributor, which involves physical contact between a rotor and contacts for providing electrical current to each of the spark plugs in the engine, emits a small amount of radio frequency (RF) noise. This RF noise resulting from sparking is low power spread spectrum noise which can be picked up using an antenna which in accordance with the present invention may be a simple wire within the engine compartment. The particular RF detector employed in the present invention, to be described in further detail hereinafter, filters out noise so that is does not affect the operation of sensitive electronic equipment such as the car stereo or engine computer. This RF noise is readily detectable as a fingerprint of the distributor, and that therefore, the engine is running. Furthermore, this fingerprint can be used to detect the engine speed by counting the number of such occurrences in a particular time interval. This provides a signal in, for example, revolutions per minute (RPM).

While it is preferred to count pulses corresponding to RF bursts resulting from sparking to obtain an RPM signal, it will be appreciated that in applications where it is only required to know whether or not an engine is running, a simpler analysis may be used to output a boolean signal indicating the running state of the engine.

Figure 2:
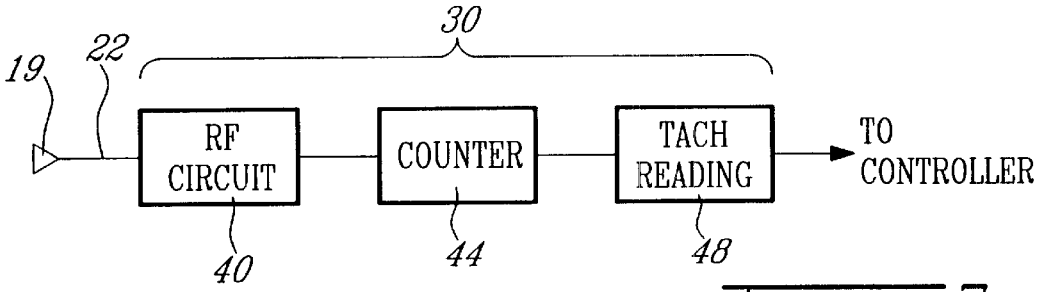
FIG. 2 is a further block diagram of the tachometer apparatus of the present invention.

Reference is now made to FIG. 2 which shows some further detail of the tachometer circuit 30. FIG. 2 illustrates the RF detector circuit 40, a counter 44 and an output block 48 indicating the tachometer reading. This is coupled to the controller 10. Detector circuit 40 receives the bursts of RF signal, and converts this to a zero-to-five volt pulse signal. These pulse signals are counted over a predetermined period of time to provide the tachometer reading (see block 48) in, for example, revolutions per minute of the vehicle engine.

In FIG. 2 it is noted that there is shown the antenna 19. The RF detector circuit 40 uses, in a preferred embodiment, as the antenna, the existing hood pin switch wire 19, which is usually a safety feature of the system. The hood pin switch 18 is located in the engine compartment, as noted in FIG. 3 and is used to monitor the opening of the hood to disable the remote engine starter if the hood is open. Its proximity to the engine cylinders and ignition system makes it possible to use the hood sensor line to detect the RF signal generated by the firing of the spark plugs in the engine compartment. The hood pin switch 18 is grounded to the vehicle chassis, and the wire 19 is thus a single unshielded conductor and can act as an efficient antenna.

The signal produced by the firing of the spark plugs that is detected and amplified by the RF pulse detector 40 is at a low level, low repetition rate (below 200 Hertz) with high frequency content above 100 KHz for each pulse generated by the firing of the engine cylinders.

The signal produced by the detector 40 is representative of the summation of all the cylinders high voltage dischargers whether the engine employs a single ignition coil or multiple coils. During the engine starting and running phase, the remote engine starter controller is processing this tachometric signal to insure that the engine has started properly and is running on its own.

Figure 4:
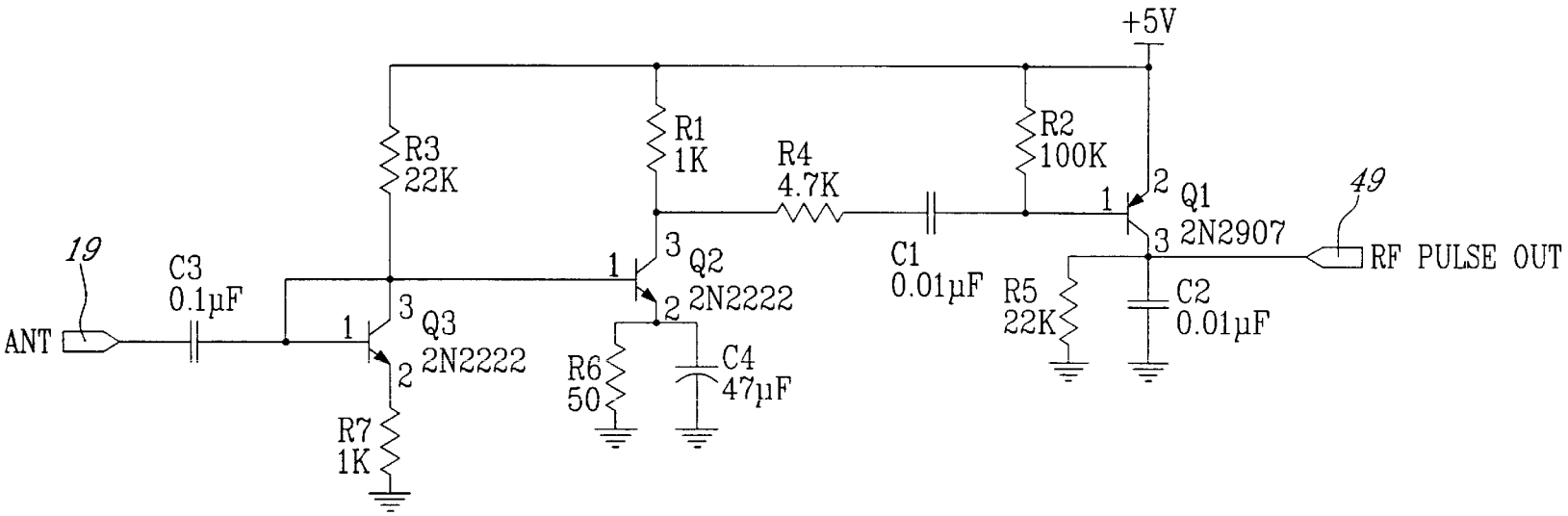
FIG. 4 is a specific circuit implementation of the RF detector.

With respect to the RF detector circuit 40, reference is now made to the specific circuit diagram of FIG. 4. FIG. 4 illustrates the antenna 19 coupled to the input of the circuit. The circuit includes transistors Q1, Q2, and Q3. This circuit provides the proper filtering and also provides at its output 49 a zero to five volt transition pulse upon detection of an RF pulse. The minimum RF pulse amplitude that is detected is 20 mv of peak amplitude. Regarding the RF pulse frequency, this is spread spectrum typically from 100 kHz to 20 MHz with a pulse width of 0.05 microseconds. It is noted that the typical repetition rate of RF pulses (one per cylinder) is relatively slow, on the order of up to 200 Hz.

In FIG. 2, the counter 44 is illustrated to simply indicate that there is a count provided that would correspond to the speed of revolution of the engine. This would mean that at the output of the tachometer reading block 48, there is a signal indicative of the speed of revolution of the running engine. Of course, if the engine has not started then the signal would not exist. It will be appreciated that the number of pulses per revolution of the engine is the number of cylinders. Thus to know the exact engine speed, one must know the number of cylinders. Furthermore, it may be possible that the combination of the geometry of the engine and antenna, as well as the discrimination threshold of detector circuit 40, could result in no or only sporadic detection of RF energy generated by one of the cylinders. In this case, the engine speed may be determined from the shortest time gap between the pulses from circuit 40 and the number of cylinders.

Regarding the circuit of FIG. 4, the input of this circuit couples to the base of transistor Q3. The emitter of transistor Q3 couples by way of resistor R7 to ground. The collector of transistor Q3 couples by way of resistor R3 to the positive voltage supply. The collector of transistor Q3 also couples to the base of transistor Q2. The emitter of transistor Q2 couples by way of resistor R6 and parallel capacitor C4 to ground. The collector of transistor Q2 couples by way of resistor R1 to the positive voltage supply and also couples by way of resistor R4 and coupling capacitor C1 to the base of transistor Q1. The emitter of transistor Q1 as well as resistor R2 is coupled to the positive voltage supply. The output of the circuit is taken at the collector of transistor Q1. The collector of this transistor also couples by way of resistor R5 and parallel capacitor C2 to ground.

There has been described herein a preferred antenna arrangement using the existing hood pin switch wire. However, other wiring found particularly in the proximity of the engine compartment, can be used as the antenna structure for detecting RF signals from the engine. For example, a power wiring may be used for an antenna structure. Also, a separate dedicated antenna structure may be employed.

It is noted that there is a clear benefit to the pulse detection apparatus and method of this invention for monitoring engine running status. This is carried out in the present invention essentially in a "wireless" manner. The system and method of the present invention does not require the connection of a sense wire to the ignition coil or inductive coupling of wires from spark plugs. There is no need to locate a specific tachometer wire and to install an extra sense line. Thus, the method and apparatus of the present invention is much more simplified and is far easier to install than prior art techniques.

What is claimed is:

1. In a remote vehicle starting system having a controller that may be remotely activated to initiate a starting of a vehicle engine, a tachometer apparatus for providing tachometric information to said controller, said apparatus comprising:

an antenna disposed proximate to a compartment of the vehicle engine and adapted to pick-up an RF signal generated by firing of spark plugs in the vehicle engine compartment; and an RF detector having the antenna coupled to an input thereof and providing at its output a tachometer signal for coupling to said controller and providing a signal indicative of a running status of the vehicle engine.

2. The apparatus as claimed in claim 1, wherein said antenna comprises hood pin switch wiring.

3. The apparatus as claimed in claim 1 wherein said RF detector detects a spread spectrum noise signal resulting from sparking.

4. The apparatus as claimed in claim 3 wherein spread spectrum signal is a low power signal.

5. The apparatus as claimed in claim 1 wherein said RF detector includes a filter.

6. The apparatus as claimed in claim 1 wherein said RF detector converts a spread spectrum noise signal into a digital pulse signal corresponding to individual spark plug firings.

7. The apparatus as claimed in claim 6 wherein said RF detector further comprises a pulse analyzer analyzing said digital pulse signal to output an engine revolutions per minute (RPM) signal.

8. The apparatus as claimed in claim 6 wherein the spread spectrum signal is typically from 100 kHz to 20 MHz.

9. The apparatus as claimed in claim 1 wherein said RF detector outputs a logic signal indicative of a running state of said engine.

10. In a remote vehicle starting system having a controller that may be remotely activated to initiate a starting of a vehicle engine, a tachometer apparatus for providing tachometric information to said controller, said apparatus comprising:

an antenna means disposed proximate to a compartment of the vehicle engine and adapted to pick-up an RF signal generated by firing of spark plugs in the vehicle engine compartment;

an RF detector means having the antenna means coupled to an input thereof and providing at its output a tachometer signal for coupling to said controller and providing a signal indicative of a running status of the vehicle engine; and means for coupling the antenna means to the RF detector means to provide said tachometer signal.

11. The apparatus as claimed in claim 10 wherein said antenna means is formed by the existing hood pin switch wiring.

12. The apparatus as claimed in claim 10 wherein said RF detector means comprises first, second, and third transistors.

13. The apparatus as claimed in claim 12 wherein said first transistor is an output transistor, said second transistor is an intermediate transistor and said third transistor is an input transistor.

14. The apparatus as claimed in claim 13 wherein a collector of the output transistor forms the output of said RF detector means and a base of the third transistor defines the input of the RF detector means, a first RC circuit is connected to a collector of the first transistor, a second RC circuit is connected to an emitter of the second transistor, a coupling capacitor coupled between the second and third transistors, said coupling capacitor couples by way of a resistor between a collector of the second transistor and a base of a first transistor.

15. A method of providing tachometric information to a controller that is part of a remote vehicle starting system, said method comprising the steps of:

detecting an RF signal generated by firing of spark plugs in an engine compartment; and generating a tachometer signal derived from the detected RF signal, coupled to the controller and indicative of a running status of the vehicle engine.

16. The method as claimed in claim 15 including employing an antenna disposed proximate to the engine compartment of the vehicle and adapted to pick up the RF signal.

17. The method as claimed in claim 16 including using as the antenna an existing hood pin switch wiring.

18. The method as claimed in claim 15 wherein the detected RF signal represents individual sparkings, the step of generating a tachometer signal comprises analyzing said RF signal to generate an engine revolutions per minute (RPM) output signal.

19. The method as claimed in claim 18 wherein said step of detecting comprises converting a spread spectrum signal into a digital pulse signal.

20. The method as claimed in claim 15, wherein said tachometer signal is a boolean signal indicating whether or not said engine is running.

* * * * *